United States Patent [19]

Kimon

[11] Patent Number: 4,565,531

[45] Date of Patent: Jan. 21, 1986

[54] SHIP PROPULSION SYSTEM

[75] Inventor: Peter M. Kimon, Mendham, N.J.

[73] Assignee: Exxon Research and Engineering Co., Florham Park, N.J.

[21] Appl. No.: 583,434

[22] Filed: Feb. 24, 1984

[51] Int. Cl.[4] ..... B64C 11/28

[52] U.S. Cl. ..... 440/50; 440/49; 416/87

[58] Field of Search ..... 440/49, 50; 416/87–89

[56] References Cited

U.S. PATENT DOCUMENTS

| | | | |
|---|---|---|---|
| 2,481,751 | 9/1949 | James | 170/160.52 |
| 2,528,609 | 11/1950 | Rouse | 170/160.57 |
| 3,565,544 | 2/1971 | Marshall | 416/89 |
| 3,606,571 | 9/1971 | Wood | 416/87 |
| 4,142,697 | 3/1979 | Fradenburgh | 416/87 |
| 4,427,341 | 1/1984 | Eichler | 416/87 |

*Primary Examiner*—Trygve M. Blix
*Assistant Examiner*—C. T. Bartz
*Attorney, Agent, or Firm*—Donald F. Wohlers

[57] ABSTRACT

An improved efficiency propulsion system and method of improving the efficiency of a vessel operated in deep and shallow water depths and at constant or variable loaded and ballast waterlines contemplates the use of a variable diameter propeller means capable of varying between a maximum extended diameter D and a minimum effective diameter D mounted on a propeller shaft having an axis of rotation displaced from the bottom keel of the ship a distance less than one-half the maximum diameter D of the propeller means. In this way, because of the use of the variable diameter ship propeller, the propulsion shaft may be located closer than otherwise permissible to the bottom keel of the ship which has the result of lowering the top blade tip trajectory relative to any particular chosen waterline and also providing space for a generally larger diameter more efficient propeller installation. Additionally, because of the ability to decrease the diameter of the propeller when desired, the bottom blade tips of the propeller may be maintained above the bottom keel of the ship when the ship is operating in shallow waters. However, upon return to deep water depths in the open sea, the diameter of the propeller may be extended to gain optimum operating efficiency.

10 Claims, 1 Drawing Figure

SHIP PROPULSION SYSTEM

BACKGROUND OF THE INVENTION

It is well known that directionally, propeller efficiency improves as the propeller diameter increases and the speed (RPM) at which the propeller turns decreases. For this reason large cargo vessels, bulk carriers, tankers, etc., are commonly fitted with fuel efficient relatively large diameter slow-turning propellers, typically 20 to 30+ feet in diameter. However, the normal restraint on larger propeller diameter and therefore efficiency is that the tips of the propeller should not extend beyond or lower than the bottom keel of the vessel because of the risk of propeller damage upon inadvertent grounding of the ship in shallow waters. Furthermore, as the diameter of the ship propeller is increased, all the time maintaining the bottom tip path of the blades above the keel bottom, the upper tip path of the propeller will be higher and higher in the water approaching the light water line operating condition of the ship. Should the propeller tips come close to the waterline or extend above it, the propeller may lose more efficiency as a result of cavitation or ventilation than the efficiency gained by the increase in diameter.

Accordingly, in the design of ship propulsion systems, the selected propeller size and the chosen RPM for driving it at the ship's design speed represents a compromise or tradeoff between several variables, namely propeller efficiency in the loaded condition of a variable draft vessel such as a tanker vs. the propeller efficiency and its efficiency in the ballast or lightened draft operating condition.

The foregoing aspects of cargo vessel propulsion design are particularly important for cargo vessels which spend a high percentage of their operating time in lightly loaded condition, or in ballast which usually means empty of cargo returning to a loading port for the acceptance of another cargo. Such return ballast voyages can be accomplished most efficiently (requiring minimum propulsion power) if the vessel is at its minimum draft. However, as previously related, a constraint on the minimum draft will always be the reduced efficiency of the propulsion system, as the ship becomes higher and higher in the water, due to the fact that a portion of the propeller arc (the propeller tips) will break the water surface. Accordingly, it has been the practice to keep the ship sufficiently down with ballast water during such return voyage to keep the propeller fully submerged, or alternatively operate the ship with greater trim by the stern (greater immersion of the stern and less of the bow), or alternatively to lower the diameter of the chosen propeller for the ship design so that it may operate in lighter ballasts without breaking the water surface. The first and second of the foregoing alternates restrict the potential for operating with lighter ballast or minimum trim which inherently are more fuel efficient, requiring less horsepower to achieve a given ship speed. The third alternate of lower propeller diameter as explained earlier lowers the propulsion efficiently resulting again in higher fuel consumption.

SUMMARY OF THE INVENTION

With the foregoing operational parameters and limitations in mind, the present invention contemplates an improved effficiency propulsion system and method of improving the efficiency of a cargo vessel operated in deep and shallow depth waters and at variable loaded and ballast water lines. The invention contemplates the use of a variable diameter propeller means capable of varying between a maximum extended diameter D and a minimum effective diameter d mounted on a propeller shaft having an axis of rotation displaced from the bottom keel of the ship a distance less than one-half the maximum diameter D of the propeller means. In this way, because of the use of the variable diameter ship propeller, the propulsion shaft may be located closer than otherwise permissible to the bottom keel of the ship which has the result of lowering the top blade tip trajectory relative to any particular chosen water ballast waterline. Additionally, because of the ability to decrease the diameter of the propeller when desired, the bottom blade tips of the propeller may be maintained above the bottom keel of the ship when the ship is operating in shallow waters. However, upon return to deep water depths in the open sea, the diameter of the propeller may be extended to permit optimum operating efficiency at maximum propeller diameter.

Accordingly, it is an object of the present invention to provide an improved efficiency propulsion system for a ship intended to be operated in deep and shallow depth waters at variable loaded and ballast water lines.

A further object of the invention is to provide a novel method for improving the efficiency of a propulsion system for a cargo vessel which is operated in deep and shallow depth waters and at variable loaded and ballast water lines.

Yet another object of the invention is to provide a ship with a propulsion system including a variable diameter propeller means mounted on a propeller shaft displaced from the bottom keel of the ship a distance less than one-half of the maximum diameter of said propeller.

Yet another object of the invention is to provide a variable diameter propeller propulsion system for a ship wherein a proper torque RPM balance may be readily accomplished for different ballast and loaded operating conditions of the vessel.

These and other objects and advantages of the invention will become apparent and the invention will be fully understood from the following description and drawing in which:

FIG. 1 is a broken side elevation view of a typical tanker vessel such as an oil tanker designed to operate in both loaded and ballast conditions.

DETAILED DESCRIPTION OF THE INVENTION

Figure 1:
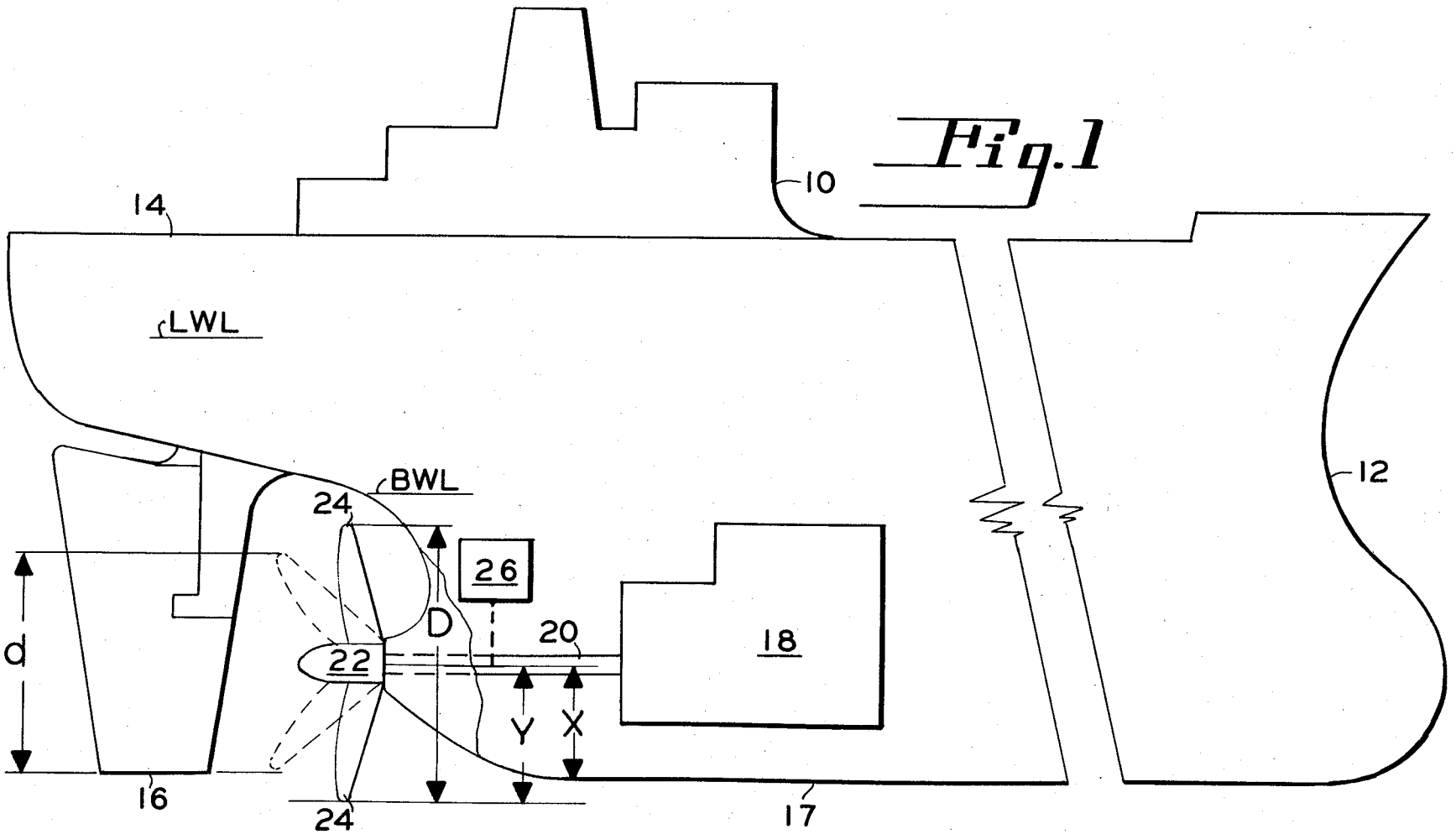

Referring to the drawing, a cargo vessel such as a tanker or bulk carrier is generally indicated at 10 and includes a bow 12 and a stern 14. The vessel 10 includes a rudder 16 and a so-called bottom keel 17. The propulsion system for the vessel 10 includes an engine designated 18 connected through a propeller drive shaft 20 to a central hub 22 of a propeller having a plurality of blades 24. While drive shaft 20 has been shown generally parallel to the bottom keel 17, such term will also include drive shaft axes extending at small angles relative to the keel. Element 26 schematically designates a propeller pitch and diameter control mechanism connected through any suitable conventional means to the propeller hub 22 to vary the desired propeller diameter and/or propeller rake and/or propeller pitch of each of the individual propeller blades 24. Such control mechanism connection is indicated by a dotted line on the drawing but will be readily understood by those skilled in the art to be of either hydraulic, mechanical, electric, or pneumatic to effect the desired physical changes in the individual propeller blades.

As is also shown in the profile view of the propeller, it can be seen that when the blades 24 are extended to their maximum diameter D, the bottom blade tip extends a distance below the bottom surface of the keel 17. When the control mechanism 26 is actuated to retract the propeller blades 24 to their dotted position shown, the extended diameter of the blade tips decreases to d as indicated on the drawing such that the lowermost blade tip is level or above the level of the keel 17 so as to be protected thereby. At the same time, it should be appreciated that the lowering of the upper blade tip when the propeller is in its minimum diameter d configuration allows the ship to be operated at lighter loads (i.e., lower ballast water lines) without the blade tips rising above the water surface. The designations LWL and BWL on the drawing indicate a typical load water line and a typical ballast water line, respectively.

Stated somewhat differently, the invention contemplates the closer than normal location of the center line of the propeller drive shaft to the keel bottom than otherwise practiced in the ship construction art. This dimension is shown in FIG. 1 as dimension X which is less than one-half the extended diameter D of the propeller or, in other words, less than the radius Y as shown. This closer than normal spacing of the shaft to the keel is effective in lowering the top of the propeller blade tips, both in an extended or in the retracted diameter configuration to allow operation at lower ballast drafts for greater ship propulsion efficiency. Ordinarily, the shaft-keel spacing is more than one-half the propeller diameter to protect and keep the propeller tip above the bottom keel 17. This ordinary propeller shaft location has the effect of keeping the top of the propeller tip trajectory relatively high in relation to the overall draft of the ship which has the subsequent consequence that the ship must be operated in ballast with a relatively high ballast line in order to keep the blade tips submerged.

In contrast, the present invention's novel overall optimization of relative dimensions and variable propeller diameter has the result of producing a system of high efficiency propulsion for a ship both while it is operated in a loaded condition in deep water and in a ballast condition in both deep and shallow waters. This improved efficiency propulsion system and method of improving the efficiency of a cargo ship operating in variable water line depths allows the ship propulsion system designer to maximize the diameter of the propeller used on any particular hull configuration to thereby optimize propeller efficiency. Additionally, it can permit operation in lighter ballast conditions which will result in additional propulsion efficiency improvements.

While a specific embodiment of the invention has been shown and described in detail to illustrate the application of the inventive principles in the environment of a variable draft cargo vessel, it will be understood that the invention may be applied to equal advantage in other type ships such as passenger ships which operate at a fairly constant draft without departing from such principles.

What is claimed is:

1. An improved efficiency propulsion system for a ship operated in deep and shallow depth waters and at variable loaded and ballast waterlines, comprising variable diameter propeller means, means for varying the diameter of said propeller between a maximum extended diameter D and a minimum diameter d, a propeller shaft mounting said propeller means for rotation in a stern portion of said ship, said propeller shaft extending generally parallel to the bottom keel of said ship and having an axis of rotation displaced from said bottom keel a distance less than one-half the maximum diameter D of said propeller means but more than one-half of said minimum diameter d of said propeller means, whereby when said ship is operated in a fully loaded condition in deep water said propeller means may be extended in diameter to obtain maximum propeller efficiency.

2. An improved efficiency propulsion system for a ship operated in deep and shallow depth waters and at variable loaded and ballast waterlines, comprising variable diameter propeller means, means for varying the diameter of said propeller between a maximum extended diameter D and a minimum diameter d, a propeller shaft mounting said propeller means for rotation in a stern portion of said ship, said propeller shaft extending generally parallel to the bottom keel of said ship and having an axis of rotation displaced from said bottom keel a distance less than one-half the maximum diameter D of said propeller means but equal to or more than one-half of said minimum diameter d of said propeller means, whereby when said ship is operated in light ballast conditions or shallow water, said propeller means may be reduced in diameter to minimize or prevent transit of the propeller blade tips above the surface of the water to thereby increase the efficiency of said ship propulsion system.

3. An improved efficiency propulsion system in accordance with claim 1 wherein said means for varying the diameter of said propeller includes hydraulic means.

4. An improved efficiency propulsion system for a ship operated in deep and shallow depth waters comprising variable diameter propeller means, means for varying the diameter of said propeller between a maximum extended diameter D and a minimum diameter d, a propeller shaft mounting said propeller means for rotation in a stern portion of said ship, said propeller shaft extending wholely above the bottom keel of said ship and having an axis of rotation displaced from said bottom keel a distance less than one-half the maximum diameter D of said propeller means but more than one-half of said minimum diameter d of said propeller means, when said ship is operated in deep water said propeller means may be extended in diameter to obtain maximum propeller efficiency and wherein when said ship is operated in shallow depth water said propeller means may be reduced in diameter to prevent possible contact of the sea bottom by said propeller means.

5. An improved efficiency oil tanker vessel for operation in deep and shallow depth waters and at variable loaded and ballast waterlines, including a propulsion system having a variable diameter propeller means, means for varying the diameter of said propeller between a maximum extended diameter D and a minimum diameter d, a propeller shaft mounting said propeller means for rotation in a stern portion of said vessel, said propeller shaft extending generally parallel to the bottom keel of said tanker vessel and having an axis of rotation displaced from said bottom keel a distance less than one-half the maximum diameter D of said propeller means but equal to or more than one-half of said minimum diameter d of said propeller means, whereby when said tanker vessel is operated in light ballast conditions, said propeller means may be reduced in diameter to minimize or prevent transit of the propeller blade tips above the surface of the water to thereby increse the efficiency of said ship propulsion system.

6. An improved efficiency cargo vessel for operation in deep and shallow depth waters and at variable loaded and ballast waterlines, including a propulsion system having a variable diameter propeller means, means for varying the diameter of said propeller between a maximum extended diameter D and a minimum diameter d, a propeller shaft mounting said propeller means for rotation in a stern portion off said vessel, said propeller shaft extending generally parallel to the bottom keel of said vessel and having an axis of rotation displaced from said bottom keel a distance less than one half the maximum diameter D of said propeller means but more than one half of said minimum diameter d of said propeller means, whereby when said ship is operated in a fully loaded condition in deep water, said propeller means may be extended in diameter to diameter D to obtain maximum propeller efficiency.

7. An improved efficiency cargo vessel for operation in deep and shallow depth waters and at variable loaded and ballast waterlines, including a propulsion system having a variable diameter propeller means, means for varying the diameter of said propeller between a maximum extended diameter D and a minimum diameter d, a propeller shaft mounting said propeller means for rotation in a stern portion of said vessel, said propeller shaft extending generally parallel to the bottom keel of said vessel and having an axis of rotation displaced from said bottom keel a distance less than one-half the maximum diameter D of said propeller means but more than one-half of said minimum diameter d of said propeller means, whereby when said ship is operated in light ballast conditions in deep water, said propeller means may be extended in diameter to diameter D to obtain maximum propeller efficiency.

8. The method of improving the efficiency of a propulsion system for a cargo ship operating in deep and shallow depth waters and at variable loaded and ballast waterlines, comprising the steps of installing a variable diameter propeller means on a propeller shaft extending generally parallel to the bottom keel of said ship and having an axis of rotation displaced from said bottom keel a distance less than one-half the maximum diameter of said propeller means but more than one half of the minimum diameter of said propeller means, and extending the propeller means to its maximum diameter D to improve its operating efficiency whenever sufficient water depth is present.

9. The method of improving the efficiency of a propulsion system for a ship operating in deep and shallow depth waters and at variable loaded and ballast waterlines, comprising the steps of installing a variable diameter propeller means on a propeller shaft extending generally parallel to the bottom keel of said ship and having an axis of rotation displaced from said bottom keel a distance less than one-half the maximum diameter of said propeller means but more than one-half of the minimum diameter of said propeller means, and varying the diameter of said propeller means as required by water depth below said bottom keel and/or said ballast water line to obtain maximum propulsion efficiency.

10. The method of improving the efficiency of light ballast operation for a cargo ship operating in deep and shallow water depths by permitting it to operate at lighter than normal ballast waterlines thereby reducing its resistance and as a result improving its overall effficiency comprising the steps of installing a variable diameter propeller means on a propeller shaft extending generally parallel to the bottom keel of said ship and having an axis of rotation displaced from said bottom keel a distance less than one-half the maximum the maximum diameter of said propeller means but more than one-half of the minimum diameter of said propeller means, and varying the diameter of said propeller means as required by water depth below said bottom keel and/or said ballast waterline to obtain maximum propulsion efficiency.

* * * * *